United States Patent [19]

Bendig et al.

[11] Patent Number: 4,796,807

[45] Date of Patent: Jan. 10, 1989

[54] ULTRASONIC ATOMIZER FOR LIQUIDS

[75] Inventors: Lothar Bendig, Pfullingen; Frieder Hofmann, Metzingen, both of Fed. Rep. of Germany

[73] Assignee: Lechler GmbH & C. KG, Fellbach, Fed. Rep. of Germany

[21] Appl. No.: 167,136

[22] Filed: Mar. 11, 1988

[30] Foreign Application Priority Data

Mar. 17, 1987 [EP] European Pat. Off. ..... 87103907.9

[51] Int. Cl.[4] ..... B05B 3/14

[52] U.S. Cl. ..... 239/102.2; 310/323; 310/325

[58] Field of Search ..... 239/102.2; 310/323, 310/325

[56] References Cited

U.S. PATENT DOCUMENTS

| | | | |
|---|---|---|---|
| 3,103,310 | 9/1963 | Lang | 239/102.2 |
| 4,533,082 | 8/1985 | Maehara et al. | 239/102.2 |
| 4,540,123 | 9/1985 | Junger et al. | 239/102.2 |

FOREIGN PATENT DOCUMENTS

| | | | |
|---|---|---|---|
| 902301 | 8/1985 | Belgium . | |
| 0200258 | 11/1986 | European Pat. Off. | 239/102.2 |
| 2841385 | 3/1980 | Fed. Rep. of Germany | 239/102.2 |
| 3030378 | 2/1982 | Fed. Rep. of Germany | 239/102.2 |
| 3233901 | 3/1984 | Fed. Rep. of Germany . | |
| 556577 | 6/1986 | U.S.S.R. | 239/102.2 |

OTHER PUBLICATIONS

Lee, H. C. et al., "High-Speed Droplet Generator", IBM Technical Disclosure Bulletin, vol. 15, No. 3 8/1972.

*Primary Examiner*—Andres Kashnikow
*Assistant Examiner*—Mary Beth O. Jones
*Attorney, Agent, or Firm*—Schlesinger, Arkwright & Garvey

[57] ABSTRACT

An ultransonic atomizer for liquids comprises a piezoelectric transducer (16) mechanically coupled to an amplitude transformer (20), an atomizing disk (21) mounted to the free end of the amplitude transformer (20), a housing (22) enclosing at least the amplitude transformer (20) and a cap (30) supporting a sieve-like diaphragm (31). The cap (30) is so mounted to the housing (22) that the diaphragm (31) rests on the atomizing disk (21). The cap (30) consists of two mutually concentric cap parts (32, 33) of which one (32) supports the diaphragm (31) and the second (33) serves to mount the entire cap (30) on the housing (22). A spring (36) is so mounted between the two cap parts (32, 33) that the sieve-like diaphragm (31) is held elastically against the atomizing disk (21) and that the opposing force from the spring (36) thereby is transmitted into the second cap part (33) fixed in the housing.

Such a liquid-atomizer is characterized in that the diaphragm (31) always rests with a precisely defined prestressing on the atomizing disk (21), whereby operational reliablity heretofore not yet achieved with the previous ultrasonic liquid atomizers is obtained.

12 Claims, 2 Drawing Sheets

ULTRASONIC ATOMIZER FOR LIQUIDS

The invention concerns an ultrasonic liquid atomizer.

The German Pat. No. 32 33 901 already has disclosed an ultrasonic atomizer evincing part of the above mentioned features. The Belgian Pat. No. 902,301 comprises a partial, further development. Latter consists of a sieve-like diaphragm deposited on the atomizing disk whereby the mist of droplets issuing from this disk is guided as a directed jet over a particular distance. The directed, jet-like mist represents a critical advantage as regards the desire to move the droplets where they are supposed to go on the object being sprayed. In particular the object of the Belgian Pat. No. 902,301 consists of a fixed attachment supporting the sieve-like diaphragm and rigidly fastened to the housing of the ultrasonic liquid atomizer. Due to the inevitable tolerances affecting all components, the diaphragm will not reliably rest at a specific pre-stressing on the atomizing disk. If the prestressing is too high, the atomizing disk will be damped and hence no longer can vibrate. If the prestressing is too low, or if there were even an air gap between diaphragm and the distributor disk, the desired diaphragm and distributor disk, the desired diaphragm effect, namely to uniformly distribute the liquid film on the atomizing disk, no longer could be achieved and the mist of droplets rising from the atomizing disk rather would be caught in the diaphragm.

On the basis of the cited state of the art, it is the object of the present invention to create an ultrasonic atomizer for liquids of the initially discussed species in such a manner that the diaphragm always shall rest at a precisely defined prestressing on the atomizing disk so as to offer the operational reliability which hitherto has not been achieved in the ultraonic liquid atomizers being discussed.

An illustrative embodiment of the invention is shown in the drawings and described below. In particular, FIG. 1 shows, partly in sideview, partly in vertical longitudinal section, an embodiment mode of the ultrasonic atomizer for liquids.

Figure 1:
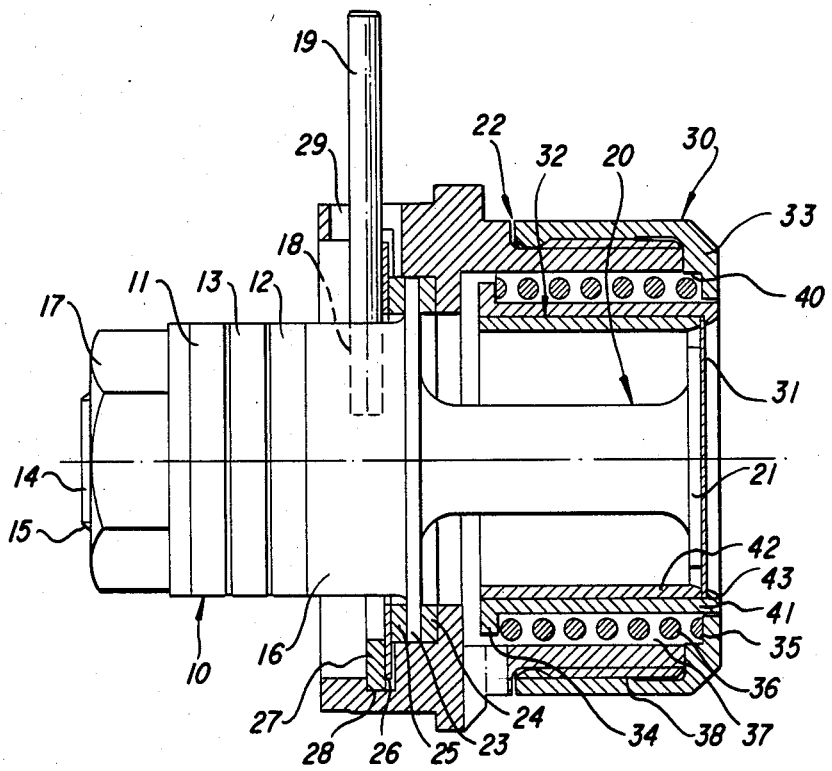
Figure 2:
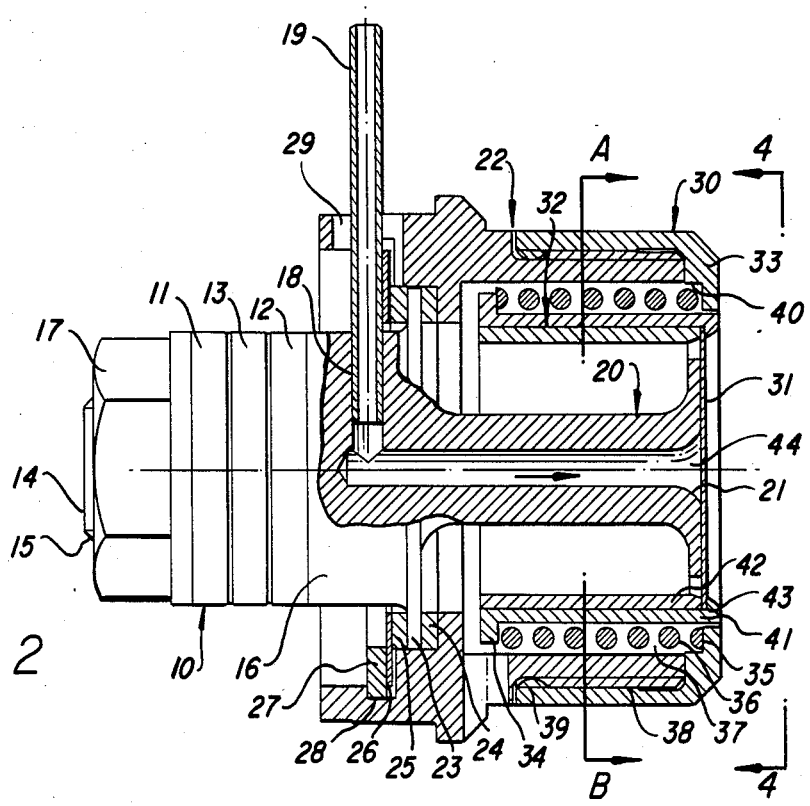
FIG. 2 shows additional longitudinal cross-sectional view of FIG. 1.
Figure 3:
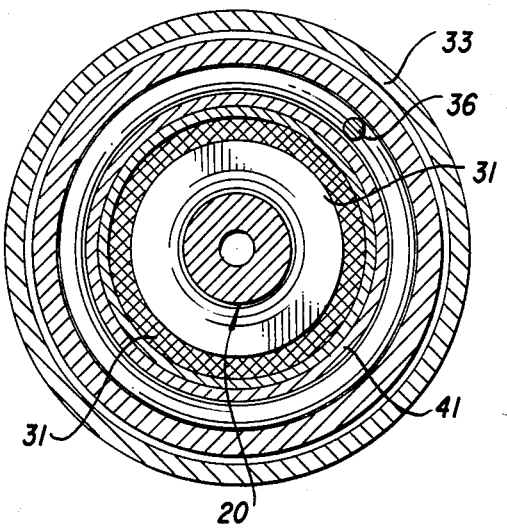
FIG. 3 is a cross-sectional view taken from FIG. 2 at A-B.
Figure 4:
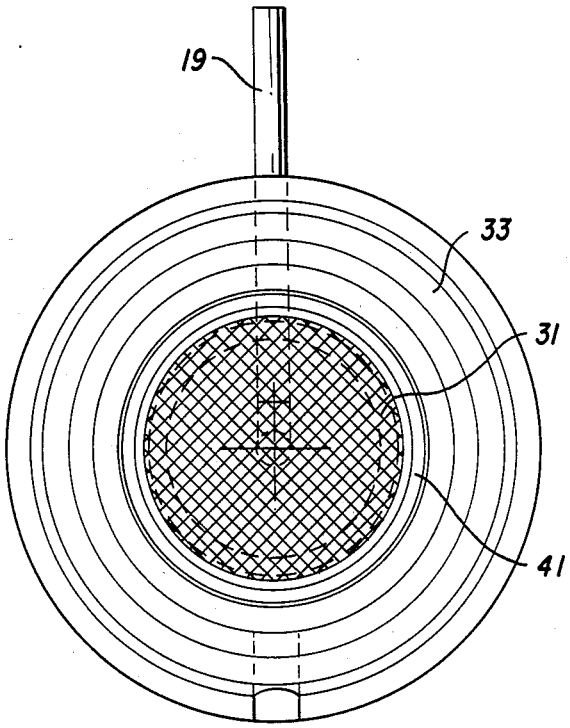
FIG. 4 is a frontal view of the embodiment taken at 4—4 in FIG. 2.

The reference numeral 10 denotes a piezoelectric transducer from electrical into mechanical energy of vibration. The piezoelectric 10 consists of two ceramic disks 11, 12. An electrode 13 is located between the two ceramic disks, 11, 12 of the piezoelectric transducer 10 and comprises an external electrical terminal (omitted from the drawing). The piezoelectric disks 11, 12 are seated concentrically on a bolt 14 provided with a thread 15. Toward the other side, to the right in the drawing, the bolt 14 widens in the form of an offset into a converter 16 acting as an axial stop on the right-hand side for the three piezoelectric disks 11, 12, and the electrode 13. On the left-hand side, the piezoelectric disks 11, 12, and electrode 13 are axially fixed by a nut 17 screwed onto the thread 15.

As further shown by the drawings, the converter 16 comprises a lateral hook-up bore 18 into which issues a liquid supply line 19. The liquid supplied through the line 19 arrives into an axial bore 44, within an amplitude transformer 20. The amplitude transformer 20 is integrally joined to the components 16 and 14. At its end, it merges, also integrally, into an atomizing disk 21. The components 20, 21 are crossed by the already mentioned bore 44 axially and centrally. The liquid to be atomized is moved on the surface of the atomizing disk 21 where, due to the high-frequency vibrations of this disk 21, the liquid is finely atomized.

The drawings further elucidate that the components 16, 20 and 21 are enclosed concetrically by an approximately cylindrical housing denoted as a whole by 22. The housing 22 is mounted on a flange 23 between the amplitude transformer 20 and the converter 16. Two annular seals 24, 25 are mounted on both sides of the flange 23 to seal the high-voltage transducer 10 from the amplitude transformer 20 in contact with the liquid. A pressure plate 26 loaded by a securing ring 27 is used to fix the housing 22 and seals 24, 25 to the flange 23, the securing ring 27 being fastened in a groove 28 of the housing 22. The housing 22 comprises a radial bore 29 through which passes the liquid supply line 19.

As further shown by the drawings, the front part of the amplitude transformer 20 inclusive of the atomizing disk 21 is enclosed inside the housing 22 by a cap denoted as a whole by 30 which supports on its front side a sieve-like diaphragm membrane 31. The cap 30 is held on the housing 22 in such a manner—further discussed below—that the diaphragm 31 rests elastically prestressed on the atomizing disk 21.

The cap 30 consists of two mutually concentric parts of which an inner, first cap part 32 supports the diaphragm 31 and an outer, second cap part serves to fasten all of the cap 30 to the housing 22. The first cap part 32 includes an outwardly radial collar 34 and the second cap part 33 an inwardly radial offset 35. A helical compression spring 36 is mounted between the two cap parts 32, 33 which it loads in mutually axially opposite directions, in such a manner that the sieve-like diaphragm 31 is kept elastically against the atomizing disk 21 and so that the opposing force of the helical compression spring 36 is transmitted to the second cap part 33 fixed in the housing. The helical compression spring 36 rests on one hand on the collar 34 and on the other on the offset 35. Due to the design features described above, an annular gap 37, is obtained between the inner wall of the housing 22, to receive the helical compression spring 36.

The drawings furthermore show that the second cap part 33 is a screw cap and is screwed on a corresponding outer thread 38 of the housing 22. Alternatively, this screw cap 33 may be replaed by a bayonet or snap-in connector to the housing 22.

The helical compression spring 36 is undetachably fixed at 40 by a press fit into the second cap part 33.

In the illustrative embodiment shown, the diaphragm 31 fastened to the front end of the first cap part 32. Accordingly, seen from the atomizing disk 21, the first cap part 32 extends to the rear. In this instance the first cap 32 consists of two concentric sleeves 41, 42 where the outer sleeve 41 comprises a bead 43 overlapping the inner sleeve 42 at the front end. The diaphragm 31 is bonded between the front end face of the inner sleeve 42 and the bead 43.

In another conceivable embodiment, the first cap part 32 also may be a plastic injection-molded part and the membrane 31 may be enclosed at its edge by the injection-molded material of the first cap part 32.

We claim:

1. An ultrasonic atomizer for liquids, comprising a piezoelectric transducer mechanically coupled to an amplitude transformer; an atomizing disk mounted on a free end of the amplitude transformer; a housing enclosing at least the amplitude transformer; a cap supporting a sieve-like diaphragm and mounted on the housing so that the diaphragm rests on the atomizing disk; said cap (30) consisting of two parts mounted mutually concentrically, an inner first cap part (32) supporting the diaphragm (31) and an outer, second cap part (33) serving to mount the entire cap (30) on the housing (22); and spring means (36) mounted between the two cap parts (32, 33) and biasing them in mutually opposite axial directions in such a manner that the sieve-like diaphragm (31) is held elastically against the atomizing disk (21) and that the opposing force from the spring means (36) is transmitted to the second cap part (33) fixed to the housing.

2. Ultrasonic liquid-atomizer defined in claim 1, wherein said first cap part (32) comprises a radially outward collar (34) and said second cap part (33) comprises a radially inward offset (35), said spring means (36) biasing said collar (34) in said one axial direction and biasing said offset (35) in said other axial direction.

3. Ultrasonic liquid-atomizer defined in claim 2, wherein said spring means (36) is received in an annular gap between the outer wall of the cylindrical first cap part (32) and the inner wall of the housing (22).

4. Ultrasonic liquid-atomizer defined in claim 3, wherein the annular gap (37) is axially bounded at its front end on the side of the atomizing disk by the offset (35) of the second cap part (32) and at its rear end by the collar (34) of the first cap part (32), said spring means comprises a helical compression spring (36).

5. Ultrasonic liquid-atomizer defined in claim 2, wherein the spring means (36) is undetachably mounted by a press-fit or a snap-in fit into the second cap part (33).

6. Ultrasonic liquid-atomizer defined in claim 1, wherein the diaphragm (31) is fastened to the front end of the first cap part (32) and in that the first cap part, (32) starting from the atomizing disk (27), extends rearward.

7. Ultrasonic liquid-atomizer defined in claim 6, wherein the first cap part (32) consists of two concentric sleeves (41, 42), the outer sleeve (41) including a bead (43) overlapping the inner sleeve (42) at the front end, and in that the diaphragm (31) is bonded between the front end face of the inner sleeve (42) and the bead (43).

8. Ultrasonics liquid-atomizer defined in claim 1, wherein the first cap part (32) is integrally injection-molded and the diaphragm (31) is enclosed at its edge by the injection-molded material of the first cap part (32).

9. Ultrasonic liquid-atomizer defined in claim 1, wherein the first cap part (33) is in the form of a cap-nut and is screwed onto a corresponding outer thread (38) of the housing (22).

10. Ultrasonic liquid-atomizer defined in claim 1, wherein the second cap part (33) is connected to the housing by a bayonet connection.

11. Ultrasonic liquid-atomizer defined in claim 1, wherein the second cap part (33) is connected to the housing by a snap-fit connection.

12. Ultrasonic liquid-atomizer defined in claim 1, wherein the housing (22) is mounted on a flange (23) formed between a converter (16) attached to the transducer and the amplitude transformer (20) and is sealed relative to the converter (16) by sealing rings (24, 25) mounted on both sides of the flange (23) and is fastened by a pressure disk (26) with a securing ring (27) to the flange (23).

* * * * *